US005160967A

United States Patent [19]

Tonegawa

[11] Patent Number: 5,160,967

[45] Date of Patent: Nov. 3, 1992

[54] IMAGE FORMING APPARATUS WITH LAYER THINNING DETECTION

[75] Inventor: Tadashi Tonegawa, Shiki, Japan

[73] Assignee: Sharp Kabushiki Kaisha, Osaka, Japan

[21] Appl. No.: 714,176

[22] Filed: Jun. 13, 1991

[30] Foreign Application Priority Data

Jun. 14, 1990 [JP] Japan ..... 2-156279
Mar. 18, 1991 [JP] Japan ..... 3-052591

[51] Int. Cl.[5] ..... G03G 21/00
[52] U.S. Cl. ..... 355/208; 355/210
[58] Field of Search ..... 355/208, 210, 211, 209, 355/228, 219, 205, 206, 203, 216

[56] References Cited

U.S. PATENT DOCUMENTS 4,136,945 1/1979 Stephens ..... 355/210
4,551,000 11/1985 Kanemitsu et al. ..... 355/200
4,585,327 4/1986 Suzuki ..... 355/210
4,851,875 7/1989 Tanimoto ..... 355/209 X
4,935,777 6/1990 Noguchi et al. ..... 355/210

FOREIGN PATENT DOCUMENTS 2-195366 8/1990 Japan .

*Primary Examiner*—A. T. Grimley
*Assistant Examiner*—Shuk Y. Lee
*Attorney, Agent, or Firm*—David G. Conlin; Robert M. Asher

[57] ABSTRACT

An apparatus for forming an image of a document, capable of charging a photoconductor by using a charging device includes a unit for detecting a value of a flowing current into the photoconductor, a unit for comparing the value of the flowing current with a predetermined life time current value of the photoconductor, and a unit for determining a layer thinning of the photoconductor at a time when the value of the flowing current exceeds the predetermined life time current value of the photoconductor so that the layer thinning is indicated.

20 Claims, 5 Drawing Sheets

IMAGE FORMING APPARATUS WITH LAYER THINNING DETECTION

BACKGROUND OF THE INVENTION

1. Field of the Invention

The present invention relates to an image forming apparatus capable of forming images on a photoconductor formed by laying a photoconductive material having a proper photoconductivity on a conductive base.

2. Description of the Related Art

The inventors of the present invention know that there is an image forming apparatus (hereinafter, it is called a copying machine) capable of forming an image by using a photoconductor having a proper photoconductivity.

In general, the photoconductor is formed by laying a photoconductive layer made of a photoconductive material on a photoconductive base made of aluminum (Al), in a shape of a drum or a belt and mounted inside of the copying machine.

An image forming part of the copying machine consists of a charger, an optical system device, a developer, a transfer device, a cleaner, a discharger, and they are arranged around the photoconductor to carry out the following processes in order;

(a) a process of uniformly charging the surface of the photoconductor.

(b) a process of forming a latent image by a radiation of light reflected by a document.

(c) a process of forming a toner image by sticking toner onto the latent image.

(d) a process of transferring the toner image onto a sheet.

(e) a process of removing residual toner from the surface of the photoconductor.

(f) a process of removing residual potential.

As the above-mentioned charger, a scolotron charger is well known and widely used.

The scolotron charger is formed of a metallic grid or a fine wire which is disposed between a corona wire and a photoconductor and enables to charge the photoconductor with a stable potential.

A corona current flowing in the corona wire is controlled by applying proper voltages to the grid.

A life of the photoconductor is determined according to the thinning degree of the photoconductive layer since the performance of the image forming apparatus will be lowered on a basis of the thinning of the photoconductive layer, as a consequence, the numbers of the formed images are substituted.

However, detecting the thinning state of the photoconductive layer is quite difficult.

In other words, when the numbers of the formed images exceed a predetermined number it is judged that the life of the photoconductor is run out and the photoconductor should be replaced with a new one.

The thinning degree of the photoconductive layer of the photoconductor varies mainly according to a density of a document image, a level of an exposure lamp and a size of an image to be formed even if only one image is formed from the document.

For the above-mentioned known image forming apparatus, the life of the photoconductor is determined on a basis of only the numbers of the formed images regardless of the image density or the image size. As a result, there is found a great difference between an actual life and the determined life of the photoconductor.

Furthermore, the photoconductor in a sufficiently usable state may be wastefully replaced for the photoconductor which is hardly deteriorated since the numbers of the formed images up to a replacement of the photoconductor is set on an assumption that the photoconductor is used in a severe state in order to prevent a use of the deteriorated photoconductor.

In a case that the damaged photoconductor is not determined as running out of the life, the qualities of the formed images will be lowered.

In addition, in a case of using the scolotron charger, the capacitance of the photoconductive layer is increased due to the thinning of the photoconductive layer since the amount of the charges on the photoconductor is increased in order to maintain a constant surface potential.

When the image exposure is performed on the photoconductor having a thinning photoconductive layer at the same exposure level as that of the exposure on the photoconductor without any thinning of the photoconductive layer, the charges on the photoconductor cannot be sufficiently canceled and the formed images by using the photoconductor having the thinning photoconductive layer are darken comparing a normal brightness of the formed images by using the photoconductor without any thinning of the photoconductive layer.

SUMMARY OF THE INVENTION

A first object of the present invention is to provide an apparatus for forming an image having a layer thinning detection device for a photoconductor, capable of detecting the life of the photoconductor precisely.

The first object of the present invention can be achieved by an apparatus for forming an image of a document, capable of charging a photoconductor by using a charging device, the apparatus includes a unit for detecting a value of a flowing current into the photoconductor, a unit for comparing the value of the flowing current with a predetermined life time current value of the photoconductor, and a unit for determining a layer thinning of the photoconductor at a time when the value of the flowing current exceeds the predetermined life time current value of the photoconductor so that the layer thinning is indicated.

Preferably, the detecting unit is a current value detection circuit and is capable of detecting the value of the current flowing which is proportional to a capacitance of a photoconductive layer of the photoconductor, the capacitance being inversely proportional to a thickness of the photoconductive layer.

More preferably, the apparatus further includes an optical device consisting of a first mirror unit and a second mirror unit for charging the photoconductor in order to form a latent image of the document on the photoconductor.

Further preferably, the first mirror unit includes a copy lamp for radiating the document and a mirror for leading a light reflected from a surface of the document radiating by the copy lamp.

The second mirror unit preferably includes a pair of mirrors, each of the pair of mirrors enabling to move in parallel with and/or in vertical to the document table so that the document place on the document table is scanned.

The determining unit preferably is capable of varying an exposure level of the copy lamp so that an amount of the reflected light from the document is varied.

The exposure level of the copy lamp is varied in proportional to the flowing current.

The apparatus further includes an alarm for indicating a replacement of the photoconductor in accordance with a result of the determining unit, preferably.

The comparing unit is formed in a central processing unit, and the determining unit also formed in the central processing unit, preferably.

The central processing unit preferably includes a read-only memory for storing the program and a random-access memory for storing data in accordance with the program stored in the read-only memory.

The data is regarding to the exposure level of the copy lamp which corresponds to the flowing current value input from the current value detection circuit.

Preferably, the central processing unit is adapted to receive the flowing current value output from the current value detection circuit, adapted to read out the exposure level corresponding to the flowing current value from a data table stored in the random-access memory, and adapted to output the exposure level to the copy lamp.

More preferably, the random-access memory is adapted to store the flowing current value at a time when a life time of the photoconductor is reached.

According to the apparatus for forming an image having the layer thinning detection device of the first invention, in a case that the photoconductor is charged by using a charger, when the thickness of the photoconductive layer is made small and the capacitance is increased, then the value of a current (flowing current value) flowing into the photoconductive layer in order to maintain a constant surface potential is increased.

Since the flowing current value is inversely proportional to the thickness of the photoconductive layer is precisely grasped by the detection of the flowing current value, at a time when the flowing current value exceeds a predetermined life current value, that is, at a time when the layer thinning of the photoconductive layer continues and the life time of the photoconductor is over or at a time when the photoconductor is damaged, a message to that effect is output outside of the apparatus. Thereby, the user of the apparatus enables to recognize the precise life time of the photoconductor.

A second object of the present invention is to provide an apparatus for forming an image having a layer thinning detection device, capable of forming an image in a stable state while preventing the formed image from being darkened due to the deterioration of the photoconductor.

The second object of the present invention can be achieved by an apparatus for forming an image of a document, capable of charging a photoconductor by using a scolotron charging device and capable of radiating light reflected from the document on the charged photoconductor through an optical device, the apparatus includes a unit for detecting a value of a flowing current into the photoconductor, a unit connected to the detecting unit for varying an exposure level of the optical device in accordance with values of the flowing current, and a unit connected to the varying unit for determining a layer thinning of the photoconductor in accordance with the varied exposure level of the optical device.

Preferably, the detecting unit is a current value detection circuit and is capable of detecting the value of the current flowing which is proportional to a capacitance of a photoconductive layer of the photoconductor, the capacitance being inversely proportional to a thickness of the photoconductive layer.

More preferably, the comparing unit is formed in a central processing unit, and the determining unit also formed in the central processing unit.

Further preferably, the central processing unit includes a read-only memory for storing the program and a random-access memory for storing data in accordance with the program stored in the read-only memory.

The data is regarding to the exposure level of the optical device which corresponds to the flowing current value input from the current value detection circuit, preferably.

The central processing unit is preferably adapted to receive the flowing current value output from the current value detection circuit.

The central processing unit is also adapted to read out the exposure level corresponding to the flowing current value from a data table stored in the random-access memory, and adapted to output the exposure level to the optical device, preferably.

According to the apparatus for forming the image, having the layer thinning detection device of the second invention, the value of the current flowing into the photoconductive layer is increased in accordance with the layer thinning since the exposure level is automatically controlled at a time when the layer thinning of the photoconductive layer is caused.

Therefore, an exposure level in accordance with the state of the photoconductive layer can be obtained by controlling the exposure level based on the flowing current.

In other words, according to the present invention, it is possible to precisely grasp the layer thinning state and to know the life time of the photoconductor by substituting the value of the current flowing into the photoconductive layer for an actual state of the photoconductor.

As a result, it is possible to prevent the sufficiently usable photoconductor from being wastefully replaced. Besides preventing the waste of the photoconductor, in a case that the photoconductor is damaged, the deterioration of the image quality can be prevented since it is possible to inform that the photoconductor is unusable due to abnormal increase of the flowing current.

Further objects and advantages of the present invention will be apparent from the following description of the preferred embodiments of the invention as illustrated in the accompanying drawings.

DESCRIPTION OF THE PREFERRED EMBODIMENTS

The embodiments of the apparatus for forming an image (hereinafter, it is called as a copying machine) having the layer thinning detection device according to the present invention will now be described in detail with a reference to the accompanying drawings.

The construction of the copying machine in this embodiment will be described with a reference to FIGS. 1 and 2.

The photoconductor 11 mounted in the copying machine is formed in a drum shape having a cylindrical drum base 11*a* and a photoconductive layer 11*b*. The photoconductor 11 is so formed that the photoconductive layer 11*b* made of an organic photoconductive material or an inorganic photoconductive material such as selenium (Se) and is laid on the cylindrical drum base 11*a* made of a conductive material such as aluminum (Al).

Figure 1:
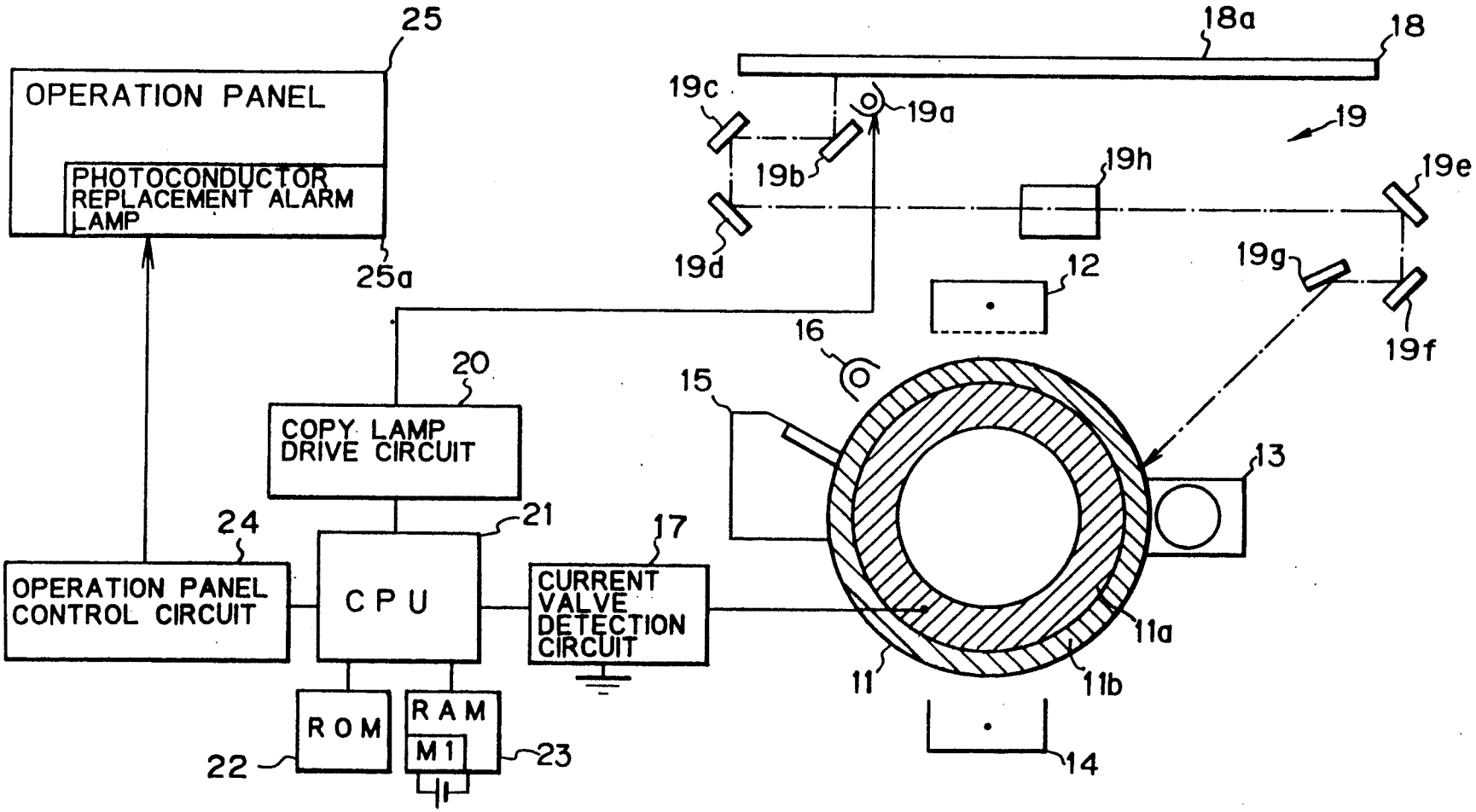
FIG. 1 is a block diagram of a principal part of an apparatus for forming an image, having a layer thinning detection device according to an embodiment of the present invention.
Figure 2:
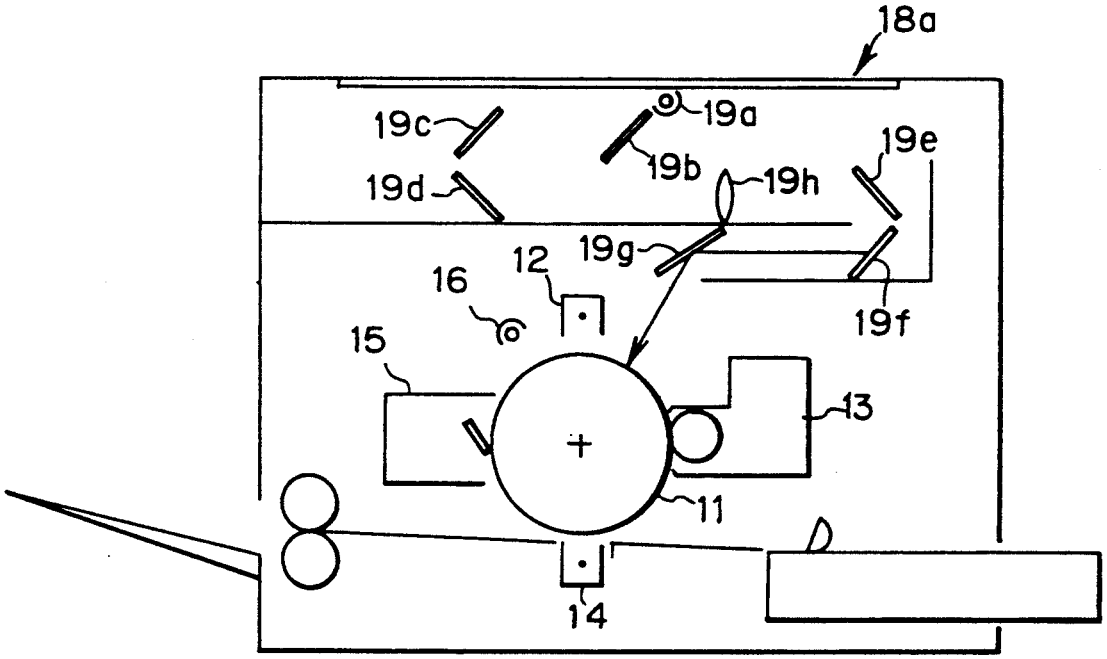
FIG. 2 is a view showing an example of the construction of the apparatus shown in FIG. 1.

The scolotron charger (hereinafter, it is called a charger) 12, the developer 13, the transfer device 14, the cleaner 15, the discharging lamp 16 are all disposed around the photoconductor 11 as shown in FIG. 1.

The cylindrical drum base 11*a* is grounded through the current value detection circuit 17.

When the photoconductor 11 is charged by the charger 12 and the surface of the photoconductor 11 is exposed, then the current value detection circuit 17 detects a value of the current (hereinafter, it is called as a flowing current value) flowing into the photoconductor 11.

The flowing current value is proportional to a capacitance of the photoconductive layer 11*b* which works as an insulator during the charging process, and the capacitance is inversely proportional to the thickness of the photoconductive layer 11*b*. In other words, the flowing current value detected by the current value detection circuit 17 is inversely proportional to the thickness of the photoconductive layer 11*b*.

Figure 3:
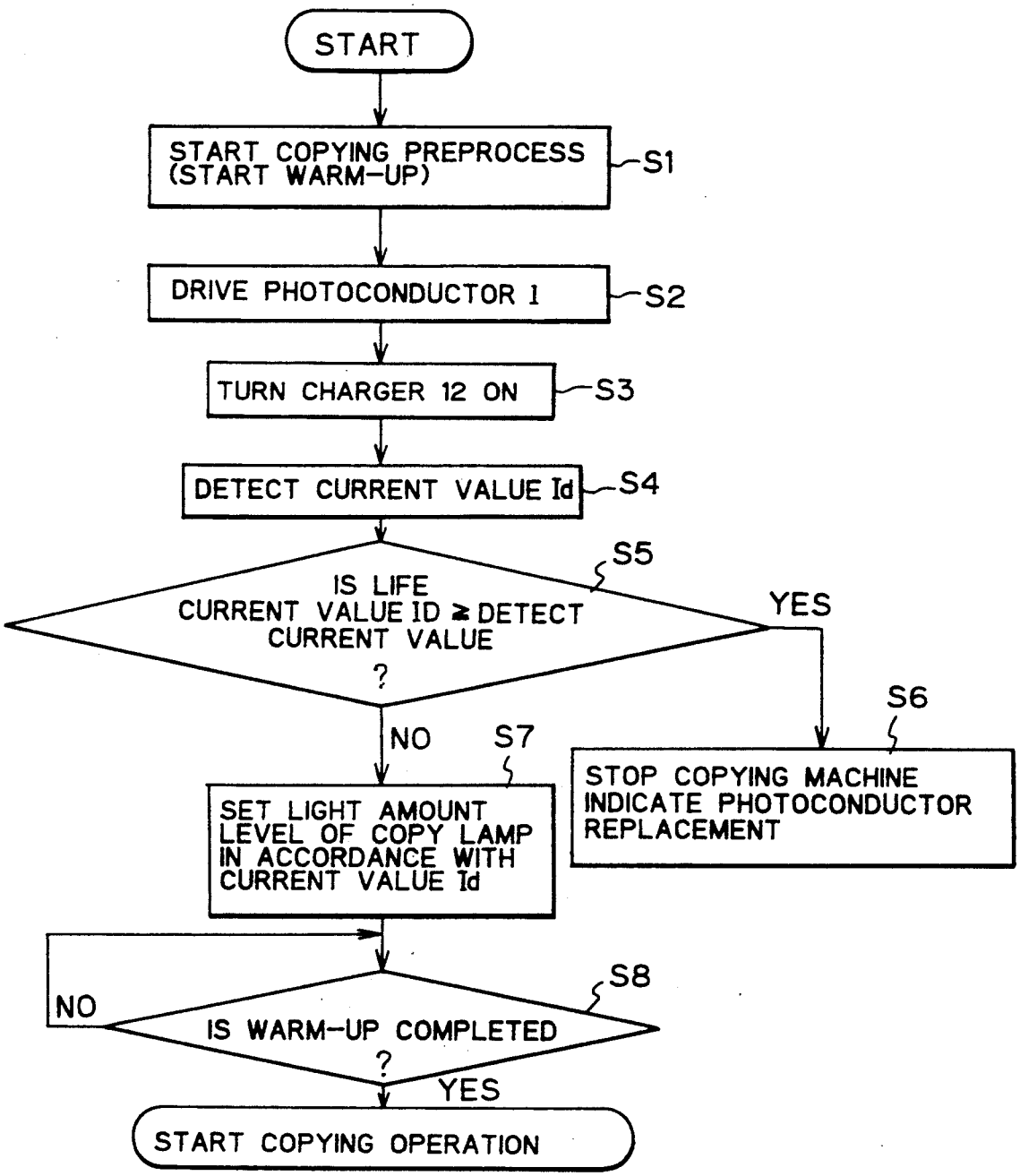
FIG. 3 is a flow chart explaining the operations of the layer thinning detection device shown in FIG. 1.

In the following, an operation of the above-mentioned copying machine will be described with a reference to FIG. 3.

First, a warm-up of the copying machine as a preprocess of copying is started (step S1) and the photoconductor 11 (also referred as the photoconductor II) is driven (step S2). When the charger 12 is turned and charges the photoconductive layer 11*b* (step S3), the values of the flowing current Id into the photoconductor 11 are detected by using the current value detecting circuit 17 (step S4). Then whether the life current value ID is less than or equal to the detected flowing current value Id is determined (step S5). In a case that the life current value ID is less than or equal to the detected flowing current value Id, then the copying machine is stopped and an alarm of replacing the photoconductor will be turned on (step S6). On the other hand, in a case that the life current value ID is greater than the detected flowing current value Id, then the light amount level of the copy lamp 19*a* is set in accordance with the flowing current value Id (step S7). Following to the step S7, whether the copying machine being warmed-up completely or not is checked (step S8), and the step S8 is repeated until the warmed-up is completed. When the copy machine is warmed-up completely, then the copying operation by the copying machine will be started.

Figure 4:
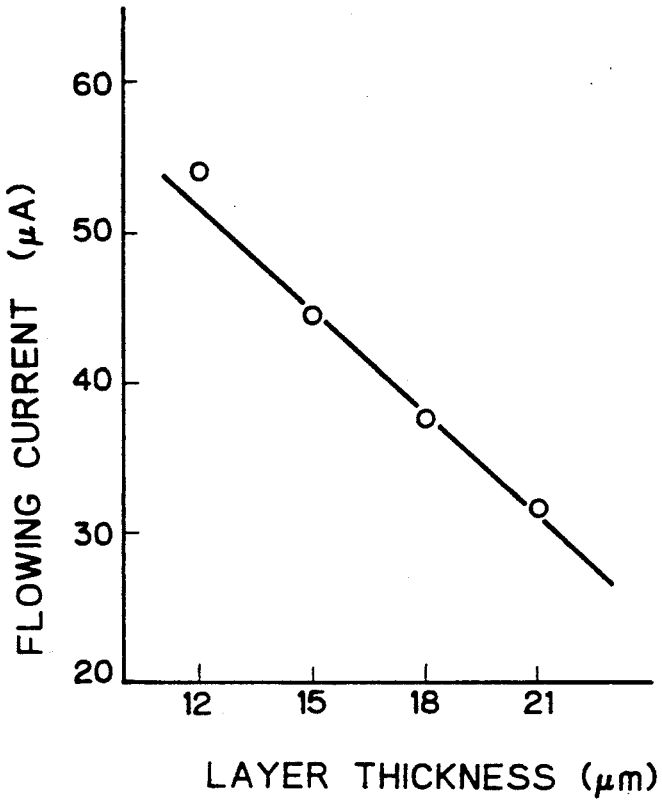
FIG. 4 is a view showing the relationship between the thickness of the photoconductive layer and the flowing current.

Table 1 shows data values of a relationship between the drum layer thickness and the current flowing into the drum which are graphically shown in FIG. 4.

TABLE 1

| | | | | |
|---|---|---|---|---|
| Layer thickness [μm] | 12 | 15 | 18 | 21 |
| Flowing current [μA] | 54 | 44.5 | 37 | 31 |

The document 18*a* to be copied is laid on a document table 18 made of a transparent glass. The optical device 19 which includes the copy lamp 19*a*, the mirrors 19*b* to 19*g* and the lens 19*h* is disposed under the document table 18.

The first mirror unit composed of the copy lamp 19*a* and the mirror 19*b*. The second mirror unit composed of the mirrors 19*c* and 19*d*, each of the mirrors 19*c* and 19*d* enables to move in parallel with and/or in vertical to the document table 18, and also enables to scan the document 18*a* laid on the document table 18.

The light reflected by the document 18*a* is led to the photoconductor 11, on which a charging process is performed through the mirrors 19*b* to 19*g* and through the lens 19*h* so that a latent image is formed on the photoconductor 11.

As the exposure level of the copy lamp 19*a* is raised, the amount level of the light reflected by the document 18*a* is also raised as a whole and the exceeded charges on the photoconductor 11 from the light are canceled, thereby the formed image is bright as whole.

In this embodiment, the exposure level of the copy lamp 19*a* is raised in accordance with an increase of the detected flowing current. In other words, in a case that the scolotron charger is used, the darkening of the image is prevented by increasing the exposure level.

The operation panel control circuit 24 is connected with the operation panel 25 mounted on the top of the body of the copying machine. The operation panel 25 includes the photoconductor replacement alarm lamp 25*a* for indicating a replacement of the photoconductor 11 to the user in accordance with a control signal output from the central processing unit (CPU) 21 through the operation panel control circuit 24.

In the following a state of the change in an actual thickness of the photoconductor 11 and a setting example of the copy lamp voltage (exposure level) according to the state will be described.

Figure 5:
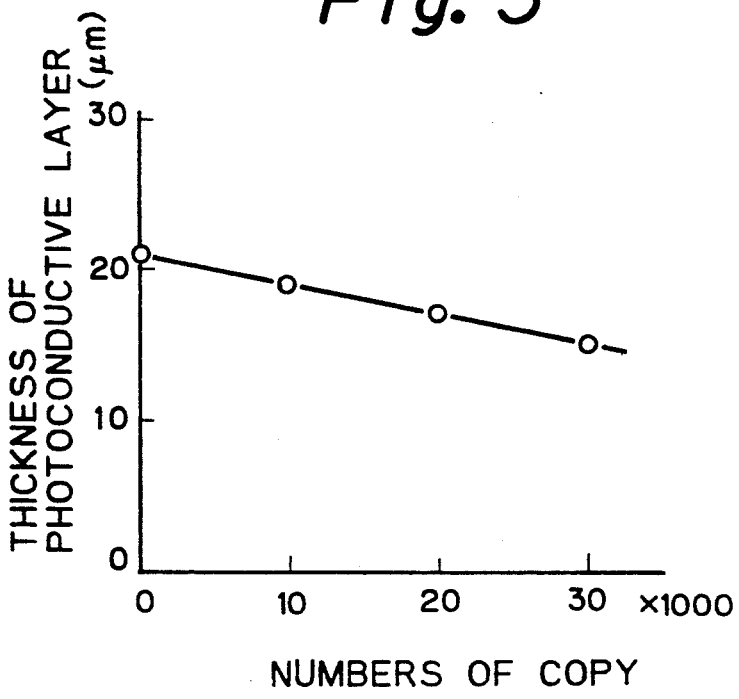
FIG. 5 is a view showing the changes in the thickness of the photoconductive layer shown in FIG. 1 due to a copying process.

FIG. 5 shows an example of the relationship between the numbers of the copies and the thickness of the photosensitive layer 11*b*, and reveals that the thickness of the photoconductive layer 11*b* is decreased with an increase of the numbers of the copies. If the thickness of the photoconductive layer 11*b* is decreased, the copy lamp voltage is adjusted in accordance with the decrease of the thickness of the photoconductive layer 11*b*.

Table 2 shows data values of a relationship between the numbers of the copies and the drum thickness which are graphically shown in FIG. 5.

TABLE 2

| Numbers of copies (×1000) | 0 | 10 | 20 | 30 |
|---|---|---|---|---|
| Drum thickness [μm] | 21 | 19 | 17 | 15 |

Figure 6:
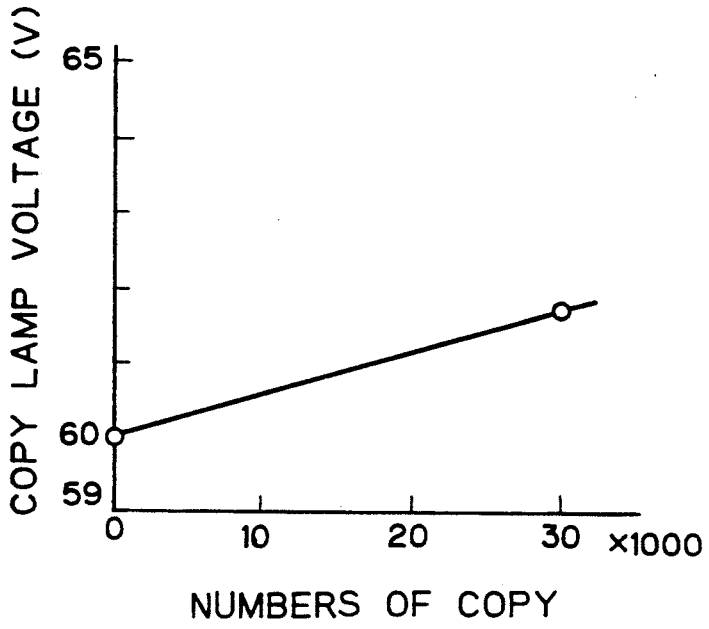
FIG. 6 is a view of setting an example of an exposure level in accordance with the change with the passage of the time due to the copying process.

FIG. 6 shows a setting example of the copy lamp voltage. For example, in a case that the thickness of the photoconductive layer 11b is changed as shown in FIG. 5, then the copy lamp voltage is adjusted as shown in FIG. 6. More specifically, the copy lamp voltage is set to 60 V when the numbers of the copies is 0, and the copy lamp voltage is set to 61.5 V when the numbers of the copies is 30,000. The copy lamp voltage is set according to a value of the flowing current since the thickness of the photoconductive layer 11b changes in accordance with the numbers of the copies and a value of the flowing current changes in accordance with the change of the thickness of the photoconductive layer 11b in a control operation.

Table 3 shows data values of a relationship between the numbers of the copies and the required copy lamp voltages (copy lamp voltages required to maintain the same copy density as the initial density) which are graphically shown in FIG. 6.

TABLE 3

| Numbers of copies (×1000) | 0 | 30 |
|---|---|---|
| Copy lamp voltage [V] | 60.0 | 61.7 |

This control operation is carried out according to a program which is stored in the read-only memory (ROM) 22. The CPU 21 controls the entire copying machine with a reference to the data stored in the random-access memory (RAM) 23 according to the program in the ROM 22.

The data of the exposure level for the copy lamp (copy lamp voltage) corresponding to the flowing current value input from the current value detection circuit 17 are stored in the memory area M1 of the RAM 23.

The flowing current value is also stored therein when the life of the photoconductor 11 is over (life current value).

The CPU 21 first takes the flowing current value from the current value detection circuit 17, reads out the exposure level corresponding to the flowing current value from the data stored in the RAM 23, and outputs the exposure level to the copy lamp drive circuit 20. At this time, if the flowing current value is more than the life current value, the exposure level is not set and a command of indicating an alarm to be set is output to the operation panel control circuit 24.

As described above, it is possible to stabilize the image quality by setting the exposure level of the copy lamp 19a in accordance with the flowing current value. Furthermore, it is preferable to measure the initial value of the current flowing into the photoconductor 11 and to set the exposure level of the copy lamp 19a in accordance with the amount of the change in the flowing current value.

Figure 7:
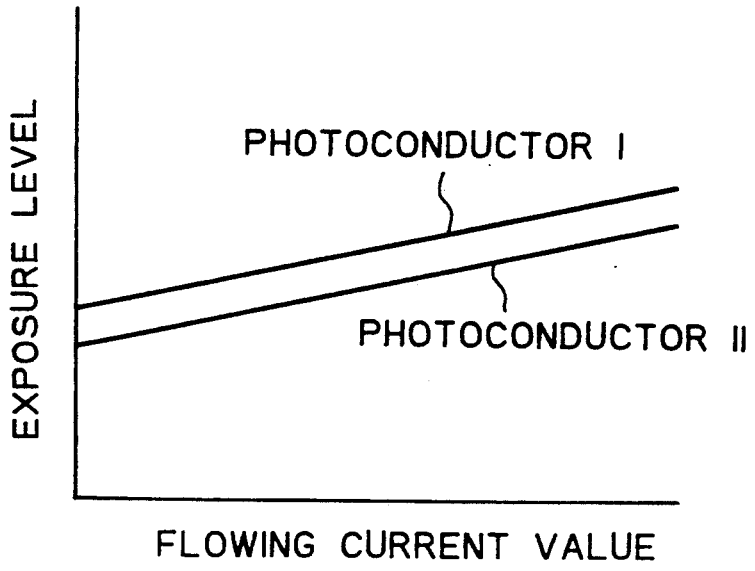
FIG. 7 is a view showing differences of the flowing current values according to the type of the photoconductor.

In other words, as shown in FIG. 7, the exposure level of the copy lamp 19a corresponding to the initial current value of the photoconductor 11 varies according to the type thereof.

Therefore, in a case that the exposure level of the copy lamp 19a is set in accordance with the flowing current value, it is likely that the image quality will be changed when the photoconductor 11 is replaced. In order to prevent the change, as described above, the data of the exposure level of the copy lamp 19a according to the amount of the charge in the flowing current is stored and the exposure level of the copy lamp 19a is set while checking the difference between the flowing current value and the initial flowing current value by referring to the data stored in the RAM 23.

In this case, the life current value is also set according to the amount of the change in the flowing current value.

In this embodiment, the timing for detecting the flowing current by the current value detection circuit 17 is set when one copying process is completed or when the power of the copying machine is turned on.

Many widely different embodiments of the present invention may be constructed without departing from the spirit and the scope of the present invention. It should be understood that the present invention not limited to the specific embodiments described in the specification, except as defined in the appended claims.

What is claimed is:

1. An apparatus for forming an image of a document, capable of charging a photoconductor by using a charging device and capable of radiating light reflected from said document on said charged photoconductor through an optical device, said apparatus comprising:

means for detecting a value of a flowing current into said photoconductor;

means connected to said detecting means for varying an exposure level of said optical device in accordance with values of said flowing current; and means connected to said varying means for determining a layer thinning of said photoconductor in accordance with said varied exposure level of said optical device.

2. An apparatus according to claim 1, wherein said detecting means is a current value detection circuit and is capable of detecting said value of said current flowing which is proportional to a capacitance of a photoconductive layer of said photoconductor, said capacitance being inversely proportional to a thickness of said photoconductive layer.

3. An apparatus according to claim 1, wherein a comparing means is formed in a central processing unit, and said determining means also formed in said central processing unit.

4. An apparatus according to claim 3, wherein said central processing unit includes a read-only memory for storing a program and a random-access memory for storing data in accordance with said program stored in said read-only memory.

5. An apparatus according to claim 4, wherein said data is regarding to said exposure level of said optical device which corresponds to said flowing current value from said detecting means.

6. An apparatus according to claim 5, wherein said central processing unit is adapted to receive said flowing current value from said detecting means.

7. An apparatus according to claim 6, wherein said central processing unit is also adapted to read out said exposure level corresponding to said flowing current value from a data table stored in said random-access memory, and adapted to output said exposure level to said optical device.

8. An apparatus for forming an image of a document placed on a document table, capable of charging a photoconductor by using a charging device, said apparatus comprising:

means for detecting a vlaue of a flowing current into said photoconductor, said detecting means being capable of detecting said vlaue of said flowing current which is proportional to a capacitance of a photoconductive layer of said photoconductor;

means for comparing said value of said flowing current with a predetermined life time current value of said photoconductor; and means for determining a layer thinning of said photoconductor at a time when said value of said flowing current exceeds said predetermined life time current value of said photoconductor so that said layer thinning is indicated.

9. An apparatus according to claim 8, wherein said apparatus further comprises an optical device for forming a latent image of said document on said photoconductor, said optical device including a first mirror unit having a copy lamp for radiating said document and a mirror for leading a light reflected from a surface of said document radiating by said copy lamp.

10. An apparatus according to claim 9, wherein said optical device further includes a second mirror unit having a pair of mirrors, each of said pair of mirrors enabling to move in parallel with and/or in vertical to said document table so that said document placed on said document table is scanned.

11. An apparatus according to claim 8, wherein said capacitance is inversely proportional to a thickness of said photoconductive layer.

12. An apparatus for forming an image of a document placed on a document table, capable of charging a photoconductor by using a charging device, said apparatus comprising:

means for detecting a value of a flowing current into said photoconductor;

means for comparing said value of said flowing current with a predetermined life time current value of said photoconductor;

means for determining a layer thinning of said photoconductor at a time when said value of said flowing current exceeds said predetermined life time current value of said photoconductor so that said layer thinning is indicated; and an optical device for forming a latent image of said document on said photoconductor, said optical device including a first mirror unit and a second mirror unit.

13. An apparatus according to claim 12, wherein said first mirror unit includes a copy lamp for radiating said document and a mirror for leading a light reflected from a surface of said document radiating by said copy lamp, and said second mirror unit includes a pair of mirrors, each of said pair of mirrors enabling to move in parallel with and/or in vertical to said document table so that said document placed on said document table is scanned.

14. An apparatus according to claim 12, wherein said detecting means is a current value detection circuit which is capable of detecting said value of said current flowing, said value of said flowing current being proportional to a capacitance of a photoconductive layer of said photoconductor, said capacitance being inversely proportional to a thickness of said photoconductive layer.

15. An apparatus according to claim 13, wherein said determining means is capable of varying an exposure level of said copy lamp so that an amount of said reflected light from said document is varied.

16. An apparatus according to claim 15, wherein said exposure level of said copy lamp is varied in proportion to said flowing current.

17. An apparatus according to claim 12, wherein said apparatus further comprises an alarm for indicating a replacement of said photoconductor in accordance with a result of said determining means.

18. An apparatus according to claim 13, wherein said comparing means and said determining means are formed in a central processing unit, said central processing unit including a read-only memory for storing a program and a random-access memory for storing in accordance with said program stored in said read-only memory, data regarding to an exposure level of said copy lamp which corresponds to said flowing current value from said current value detection circuit.

19. An apparatus according to claim 18, wherein said central processing unit is adapted to receive said flowing current value from said current value detection circuit, adapted to read out said exposure level corresponding to said flowing current level from a data table stored in said random-access memory, and adapted to output said exposure level to said copy lamp.

20. An apparatus according to claim 18, wherein said random-access memory is adapted to store said flowing current value at a time when a life time of said photoconductor is reached.

* * * * *